US005609115A

United States Patent [19]

Ayuta et al.

[11] Patent Number: 5,609,115

[45] Date of Patent: Mar. 11, 1997

[54] BUTTONHOLE CLOSING DEVICE FOR LOCKSTITCH BAR TACKING SEWING MACHINE

[75] Inventors: Masanori Ayuta, Tochigi; Koichi Nakayama, Utsunomiya; Katsuo Hiratsuka, Tochigi-ken, all of Japan

[73] Assignee: The Singer Company N.V., Curaco, Netherlands Antilles

[21] Appl. No.: 436,926

[22] Filed: May 8, 1995

Related U.S. Application Data

[63] Continuation of Ser. No. 260,445, Jun. 15, 1994, abandoned.

[30] Foreign Application Priority Data

Aug. 11, 1993 [JP] Japan ..... 5-047743

[51] Int. Cl.[6] ..... D05B 3/06

[52] U.S. Cl. ..... 112/70

[58] Field of Search ..... 112/264.1, 70, 112/76, 65, 66, 68, 71, 73, 446, 447, 448, 449, 451, 475.25

[56] References Cited

U.S. PATENT DOCUMENTS 3,795,208 3/1974 Tolle ..... 112/448

5,125,349 6/1992 Koie et al. ..... 112/66

FOREIGN PATENT DOCUMENTS 0297202 6/1971 U.S.S.R. ..... 112/70

*Primary Examiner*—Peter Nerbun

*Attorney, Agent, or Firm*—McCormick, Paulding & Huber

[57] ABSTRACT

A buttonhole closing device for a lockstitch bar tacking sewing machine comprises a feed plate for holding the buttonhole of a sewn product thereon, an arch clamp frame which is supported by the feed plate on the side thereof so as to be vertically swingable, a first and a second movable clamp feet which are swingably connected to the arch clamp frame by way of pins separately and which are arranged on the left and right sides of a center clamp foot at the clamp portions formed at the front ends thereof respectively, a clamp foot unit driving mechanism, pin portions and cam portions for converting the longitudinal movement of the clamp foot unit driving mechanism into the lateral swinging of the first and second movable clamp feet and driving units for driving the clamp foot unit driving mechanism forward or backward. As a result, it is possible to arrange the clamp foot unit driving mechanism for separately moving the first and second movable clamp feet toward the center line of the buttonhole apart from the operator's hands, so that he can secure a broad space for handling the sewn products to improve operability.

1 Claim, 7 Drawing Sheets

BUTTONHOLE CLOSING DEVICE FOR LOCKSTITCH BAR TACKING SEWING MACHINE

This is a continuation of application Ser. No. 08/260,445 filed on Jun. 15, 1994, now abandoned.

BACKGROUND OF THE INVENTION

1. Field of the Invention

The present invention relates to a buttonhole closing device for a lockstitch bar tacking sewing machine.

2. Description and Problems of the Related Art

A lockstitch bar tacking sewing machine performs a cycle of sewing operations to form a given number of stitches for bar tacking sewing, button sewing, etc., and bar tacking seams are formed using the lockstitch bar tacking sewing machine. There is known in the art an electronic bar tacking sewing machine which is electronically controlled in feeding sewn products in X (longitudinal) and Y (lateral) directions to form a seam pattern thereon. The bar tacking sewing machine which is controlled by way of a feed cam in feeding the sewn products to form a seam pattern thereon. The rotation of the arm shaft is controlled by way of a motor without the intervention of a clutch mechanism therebetween, and the like.

In conventional buttonholing, overedge chain stitches are formed around a buttonhole and thereafter bar tacking is performed at the start and end portions of the overedge chain stitches using the sewing machines of this kind. At the time of performing such a bar tacking operation, the buttonhole is closed before the bar tacking is performed thereon. This straightens loose buttonholes which are formed in the center of the overstitch chain stitches for receiving a button therein so as to put the start and end portions of the overedge chain stitches together along a line. There are known two ways of closing the buttonhole, i.e., that of moving a first movable clamp foot on the left and a second movable clamp foot on the right toward the center line of the buttonhole interlocking with the vertical movement of a clamp foot unit including the first and second movable clamp feet, and that of directly driving the first and second movable clamp feet toward the center line of the buttonhole by pneumatic actuators etc. separately.

They have, however, the following technical problems. That is, when the first and second movable clamp feet are moved toward the center line of the buttonhole interlocking with the vertical movement of the clamp foot unit for closing the buttonhole, the clamp foot unit is lowering while the first and second movable clamp feet thereof move toward the center line of the buttonhole, so that the buttonhole is liable to be closed incorrectly due to the difference in thickness of the sewn products and consequently the buttonhole is closed incompletely and a uniform seam cannot be formed. When the first and second movable clamp feet are directly driven toward the center line of the buttonhole separately by driving units each composed of a pneumatic actuator etc. for closing the buttonhole, the driving units arranged adjacent to the first and second movable clamp feet narrow a free space for handling the sewn products to set the same in place, which deteriorates operability and lowers productivity.

SUMMARY OF THE INVENTION

The present invention has been made from a viewpoint of such conventional technical problems to provide a buttonhole closing device for a lockstitch bar tacking sewing machine, the buttonhole closing device which closes a buttonhole C when a bar tacking A is performed on a sewn product 19 in which overedge chain stitches B are formed around the circumference of the buttonhole C in such a way as to cover the end portions of the overedge chain stitches B, characterized in that the buttonhole closing device comprises a feed plate 3 having an opening portion 3*a* arranged at the needle hole 13*a* of a throat plate 13 for holding the buttonhole C of the sewn product 19 thereon, an arch clamp frame 2 the rear end portion of which is supported by the feed plate 3 on the side thereof so as to be vertically swingable, a center clamp foot 1*a* which extends from the front end portion of the arch clamp frame 2 for positioning the buttonhole C of the sewn product 19 set forth above, a first movable clamp foot 1*b* and a second movable clamp foot 1*c* which are separately connected to the arch clamp frame 2 by way of pins so as to be swingable left and right being arranged on both sides of the above center clamp foot 1*a* for separately pressing on the both sides of the end portions of the overedge chain stitches B of the sewn product 19 at the clamp portions 1*h* and 1*i* formed at the front ends thereof, a clamp foot unit driving mechanism 17, pin portions 1*o* and 1*p* and cam portions 10*a* and 10*b* for receiving the pin portions 1*o* and 1*p* therein, the pin portions 1*o* and 1*p* and the cam portions 10*a* and 10*b* being arranged between the first and second movable clamp feet 1*b* and 1*c* and the clamp foot unit driving mechanism 17 for converting the longitudinal movement of the clamp foot unit driving mechanism 17 into the lateral swinging of the first and second movable clamp feet 1*b* and 1*c*, and driving units 7 and 11 provided on the arch clamp frame 2 for driving the clamp foot unit driving mechanism 17 longitudinally, wherein the cam portions 10*a* and 10*b* are formed in such a way as to open or close the first and second movable clamp feet 1*b* and 1*c* moving the clamp foot unit driving mechanism 17 forward or backward.

At first, the arch clamp frame 2 is swung upward, and the center clamp foot 1*a*, the first movable clamp foot 1*b* and the second movable clamp foot 1*c* are also raised. The clamp foot unit driving mechanism 17 is driven forward or backward by the driving units 7 and 11 so as to place the pin portions 1*o* and 1*p* at open positions in the cam portions 10*a* and 10*b* and consequently the first and second movable clamp feet 1*b* and 1*c* are swung open round the pin portions 1*o* and 1*p* respectively. As a result, the respective clamp portions 1*h* and 1*i* are apart from each other.

The sewing operation of the lockstitch bar tacking sewing machine starts at this state. At first, the buttonhole C of the sewn product 19 around which the overedge chain stitches B has been beforehand formed is place on the feed plate 3. Then the arch clamp frame 2 is swung downward. The center clamp foot 1*a* which also lowers together therewith is inserted into the buttonhole C at the tip end portion thereof to thereby accurately position the buttonhole C and consequently the portion of the buttonhole C which is subjected to bar tacking A. At the same time, the sewn product 19 is elastically pressed down on the feed plate 3 by the clamp portions 1*h* and 1*i* of the first and second movable clamp feet 1*b* and 1*c* at the portions thereof on the left and right sides of the buttonhole C respectively.

Then the lockstitch bar tacking sewing machine starts to be driven and concurrently the clamp foot unit driving mechanism 17 is moved backward or forward by the driving units 7 and 11. In this way, the clamp foot unit driving mechanism 17 is gradually moved backward or forward so as to vary the distance between the pin portions 1*o* and 1*p* in the cam portions 10*a* and 10*b*. As a result, the first movable clamp foot 1*b* and second movable clamp foot 1*c* are swung to gradually bring the clamp portions 1*h* and 1*i* close to each other. Thus the clamp portions 1*h* and 1*i* come in close contact with each other. Accompanying the closing movement of the clamp portions 1*h* and 1*i*, the portions of the sewn product 19 on both sides of the buttonhole C adjacent thereto are drawn inside by friction to close the buttonhole C.

At the state in which the buttonhole C is closed and the overedge chain stitches B around the same are in close contact with each other in this way, a cycle of sewing operation is performed to apply a bar tacking A to the sewn product 19 to form a given number of stitches over the start and end portions of the overedge chain stitches B therein. Since the driving units 7 and 11 provided on the arch clamp frame 2 drives the clamp foot unit mechanism 17 forward and backward, it is possible to accommodate the same compactly on the arch clamp frame 2, particularly preventing the same from projecting laterally.

PREFERRED EMBODIMENT OF THE INVENTION

An embodiment of the present invention will be described hereinafter.

Figure 1:
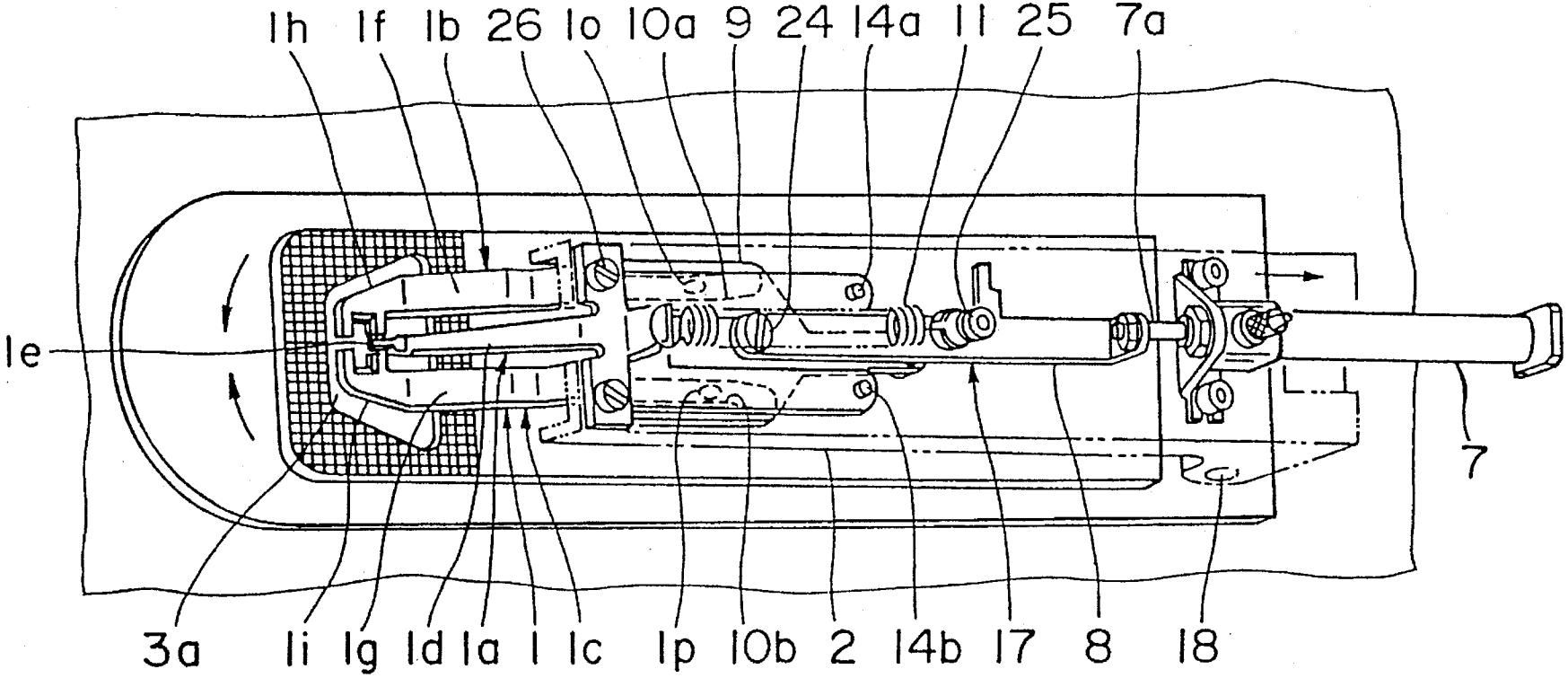
FIG. 1 is a perspective view of a buttonhole closing device for a lockstitch bar tacking sewing machine according to an embodiment of the present invention.
Figure 2:
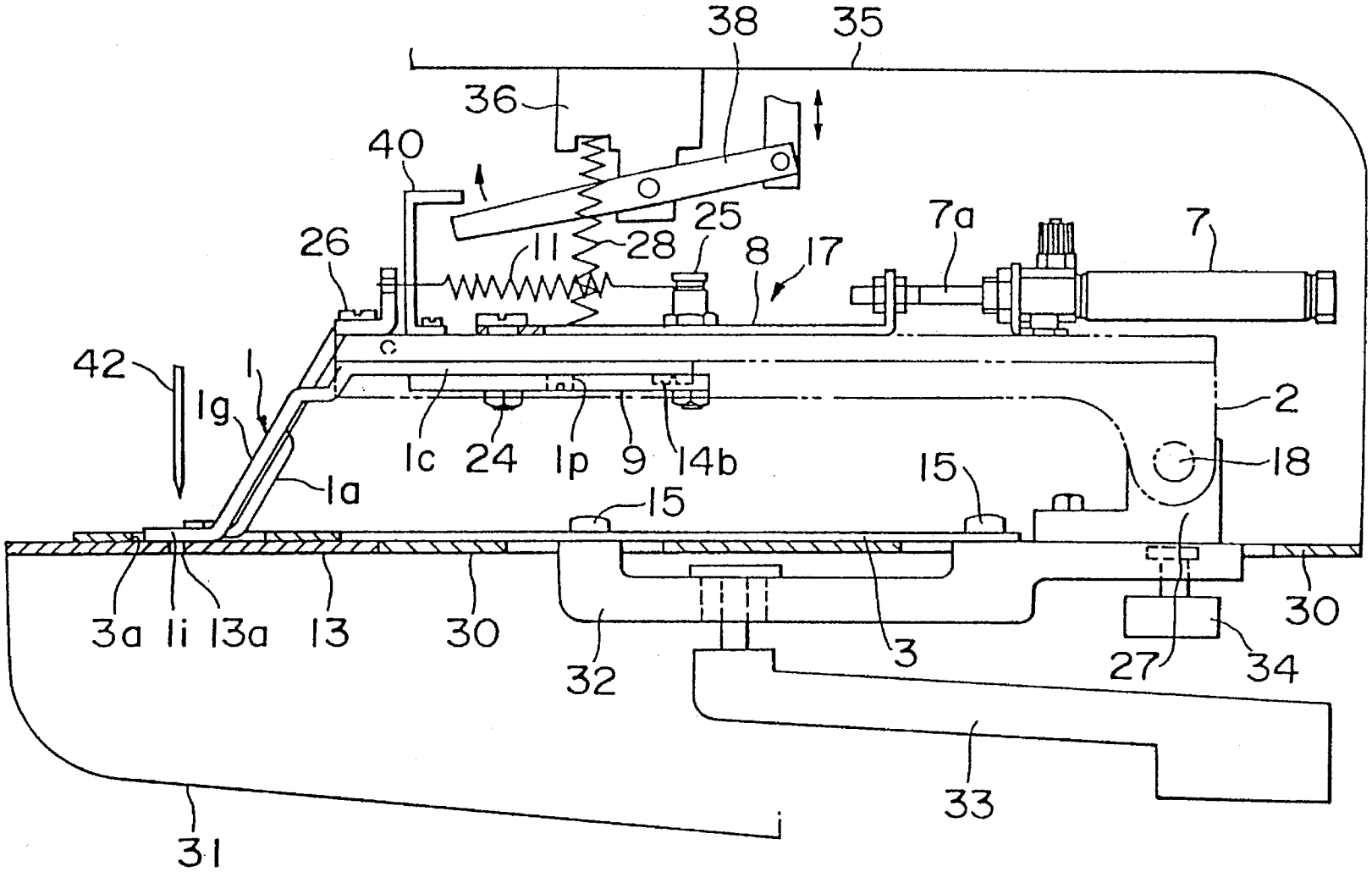
FIG. 2 is a partially cut-away view of the buttonhole closing device in FIG. 1.
Figure 6:
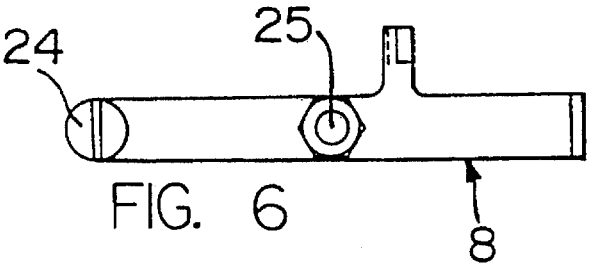
FIG. 6 is a plan view showing an upper driving member in FIG. 1.
Figure 7:
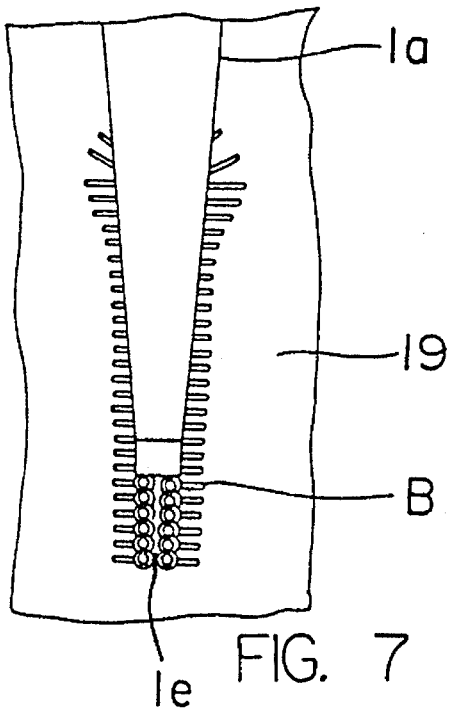
FIG. 7 is a view for explaining the operation of a center clamp foot in FIG. 1.
Figure 8:
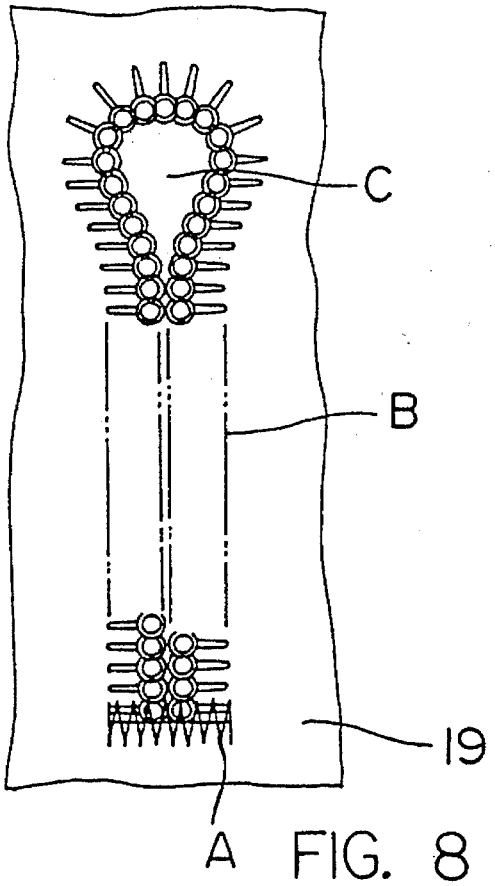
FIG. 8 is a view showing decently aligned buttonhole stitches.

FIGS. 1 to 11 show a buttonhole closing device for a lockstitch bar tacking device according to an embodiment of the present invention. The buttonhole closing device is mounted on the throat plate 13 and a cylinder cover 30. The throat plate 13 having a needle hole 13*a* through which a needle 42 passes is arranged horizontally together with the cylinder cover 30 and is fixed to a cylinder head 31 incorporated with a sewing machine bed, not shown, by way of screws. A feed plate 3 is placed on the throat plate 13 and cylinder cover 30 and a carrier bar 32 is fixed to the feed plate 3 on the lower surface thereof by way of a rivet 15 as illustrated in FIG. 2. A trapezoidal opening portion 3*a* is formed at the front end portion of the feed plate 3 and a needle hole 13*a* is formed in the throat plate 13 to be arranged at the central portion of the opening portion 3*a*. The buttonhole C of the sewn product 19 illustrated in FIG. 8 is place on the opening portion 3*a* of the feed plate 3 which is arranged on the throat plate 13 in this way.

Figure 3:
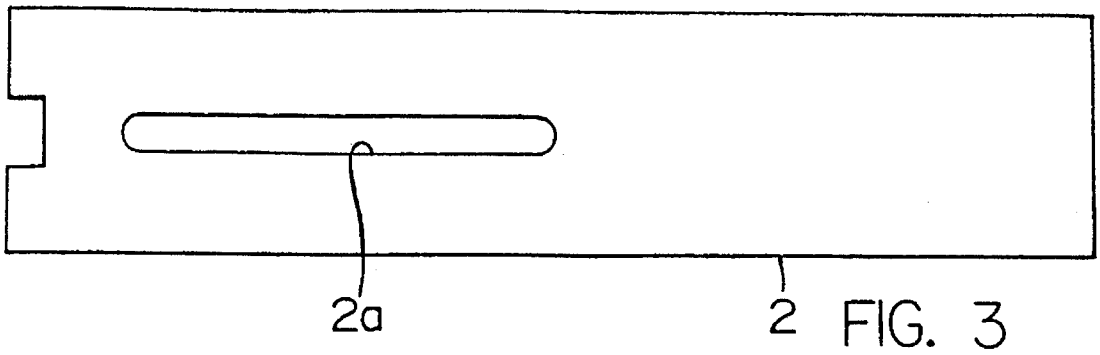
FIG. 3 is a plan view showing an arch clamp frame in FIG. 1.

An arch clamp frame 2 is swingably supported by the feed plate 3 on the side thereof, in concrete terms, by the carrier bar 32. The arch clamp frame 2 is bow-shaped and is swingably supported by a bracket 27 which is fixed to the rear end portion of the carrier bar 32 at the rear end portion thereof by way of a pin 18 illustrated in FIG. 2. A clamp foot unit 1, a clamp foot unit driving mechanism 17 and driving units 7 and 11 composed of a pneumatic actuator etc. belong to the arch clamp frame 2. A long hole 2*a* is formed in the arch clamp frame 2 in such a way as to extend from the central portion to the front end portion thereof as illustrated in FIG. 3. The arch clamp frame 2 having such construction is swung upward by way of a retaining member 40 fixed thereto by swinging a link 38 which is swingably supported by a block 36 attached to the sewing machine arm 35 and downward by the resilience of a spring 28 as illustrated in FIG. 2.

The clamp foot unit 1 is composed of a center clamp foot 1*a*, a first movable clamp foot 1*b* and a second movable clamp foot 1*c*, the first and second movable clamp feet 1*a* and 1*b* making a pair arranged on the left and right sides of the center clamp foot 1*a*. The center clamp foot 1*a* having a shape of T is composed of a rear end portion which is fixed to the front end portion of the arch clamp frame 2 by way of screws 26 and a projecting portion 1*d* which gradually inclines downward from the rear end portion toward the tip end thereof as illustrated in FIG. 1 and bends downward at the tip end portion thereof forming a narrow positioning portion 1*e* as illustrated in detail in FIG. 9.

Figure 10:
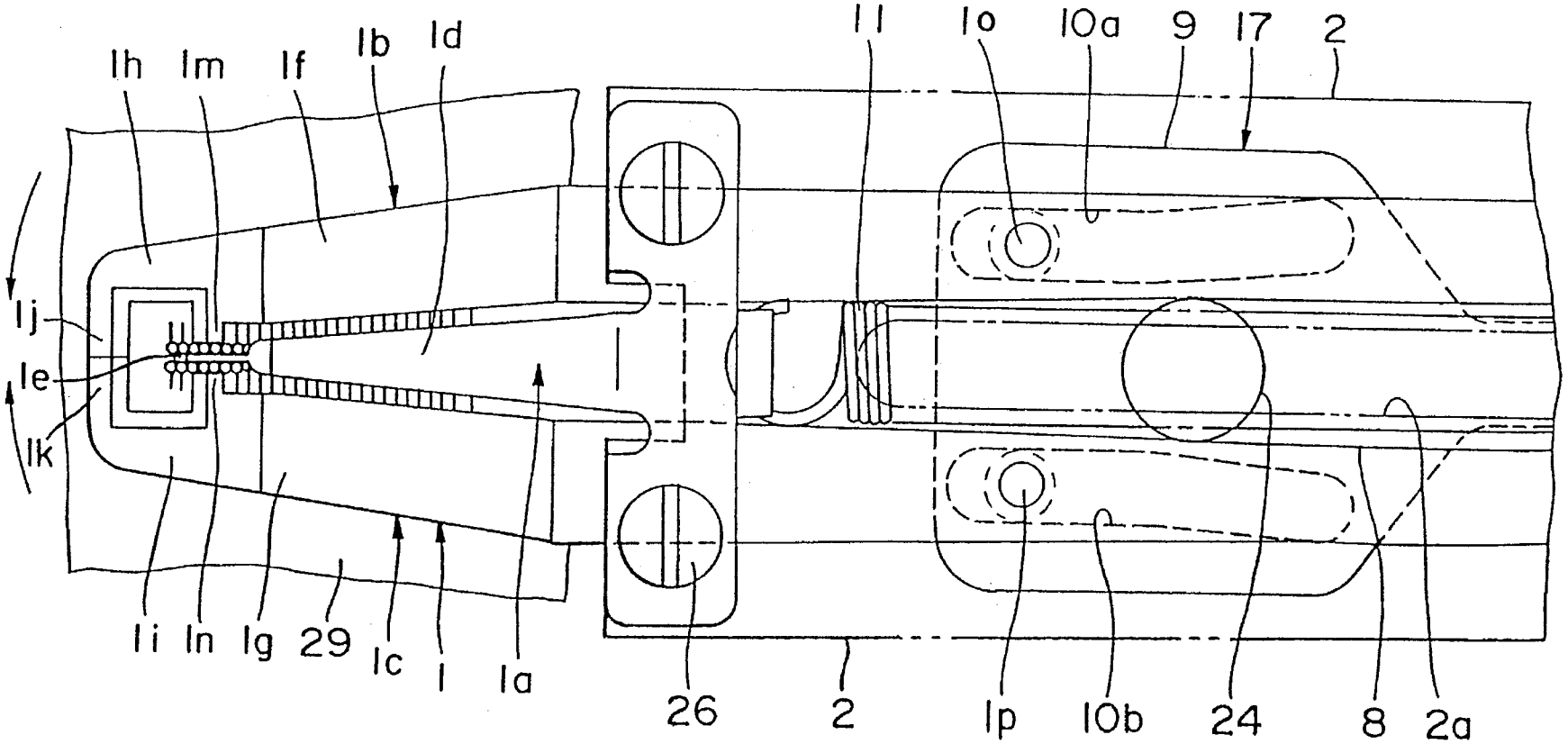
FIG. 10 is a view for explaining the operation of the buttonhole closing device in FIG. 1.

The first and second movable clamp feet 1*b* are supported by the lower surface of the central portion of the arch clamp frame 2 by way of pins 14*a* and 14*b* at the rear end portion thereof respectively in such a way as to be laterally swingable as illustrated in FIGS. 1 and 2 and have bent portions 1*f* and 1*g* which are bent downward from the central portions of the first and second movable clamp feet 1*b* and 1*c* and comprise clamp portions 1*h* and 1*i* formed at the tip end portions of the bent portions 1*f* and 1*g* being bent upward relative thereto. The clamp portions 1*h* and 1*i* each having a shape of U are brought into close contact with each other at the tip end portions 1*j* and 1*k* and at the rear end portions 1*m* and 1*n* thereof respectively in such a way as to clamp the positioning portion 1*e* of the center clamp foot 1*a* at the rear end portions 1*m* and 1*n* thereof when the first and second movable clamp feet 1*b* 1*c* are operated to close as illustrated in FIG. 10. When the arch clamp frame 2 is swung downward, the clamp portions 1*h* and 1*i* and the positioning portion 1*e* are positioned at the opening portion 3*a* and are elastically pressed upon the throat plate 13. The second movable clamp foot 1*c* has a shape symmetrical to that of the first movable clamp foot 1*b* illustrated in FIG. 5 with respect of the longitudinal axis thereof, and the clamp portions 1*b* and 1*i* have friction applying structure such as serration or knurls etc. at the lower surfaces thereof.

Figure 4:
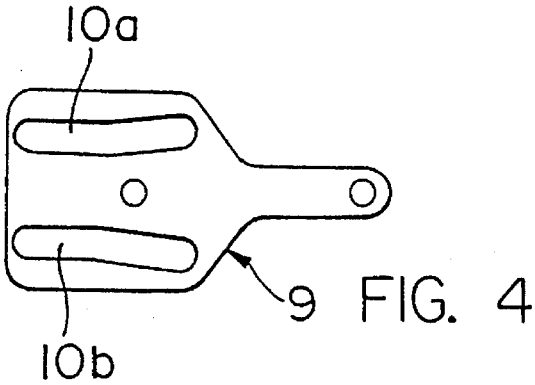
FIG. 4 is a plan view showing a lower driving member in FIG. 1.
Figure 5:
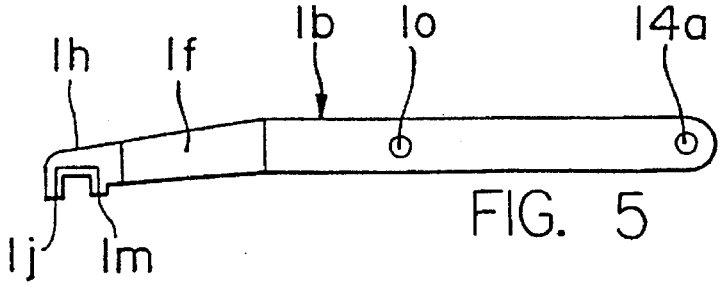
FIG. 5 is a plan view showing a first movable clamp foot in FIG. 1.

The clamp foot unit driving mechanism 17 is composed of an upper driving member 8 and a lower driving member 9. The upper driving member 8 having a shape as illustrated in FIG. 6 is arranged on the arch clamp frame 2 in such a way as to be slidable forward and backward as illustrated in FIGS. 1 and 2. The lower driving member 9 having a shape of a square table tennis racket as illustrated in FIG. 4 is arranged on the lower surfaces of the first movable clamp foot 1*b* and second movable clamp foot 1*c* under the arch clamp 2 in such a way as to be slidable forward and backward and is connected to the central portion of the upper driving member 8 at the rear end portion thereof by way of a pin 25 and to the front end portion of the upper driving member 8 at the central portion thereof by way of a pin 24 as illustrated in FIG. 2. The pins 24 and 25 pass through the long hole 2*a* of the arch clamp frame 2.

Cam portions 10*a* and 10*b* are formed in the lower driving member 9 in such a way as to be symmetrical to each other with respect to the longitudinal axis of the lower driving member 9 and be closer to each other at the front ends thereof, and the pin portions 1*o* and 1*p* which project from the first and second movable clamp feet 1*b* and 1*c* at the portions deviated backward from the central portions thereof engage the cam portions 10*a* and 10*b* respectively. The cam portions 10*a* and 10*b* are formed in such a way as to open or shut the first and second movable clamp feet 1*b* and 1*c* by moving the clamp foot unit driving mechanism 17 forward or backward. More in concrete, the first and second movable clamp feet 1*b* and 1*c* are swung open by moving the clamp foot unit driving mechanism 17 forward while they are shut by moving the clamp foot unit driving mechanism 17 backward. It is also possible to shut the first and second movable clamp feet 1*b* and 1*c* by moving the clamp foot unit driving mechanism 17 forward by way of the cam portions 10*a* and 10*b* which are arranged wider apart from each other at the front ends thereof.

The driving unit 7 is composed of a pneumatic cylinder which is fixedly mounted on the arch clamp frame 2 at the rear end portion thereof and to the rear end portion of the upper driving member 8 at the front end portion thereof while the driving unit 11 is composed of a return spring stretching between the front end portion of the arch clamp frame 2 (concretely the base portion of the center clamp foot 1*a*) and the pin 25 at the central portion of the upper driving member 8. The upper and lower driving members 8 and 9 are moved backward together by actuating the driving unit 7 of pneumatic actuator backward, while forward by the resilience of the driving unit 11 of return spring until the pin 24 at the front end portion of the upper driving member 8 is stopped by the front edge of the long hole 2*a* in the arch clamp frame 2 when the pneumatic actuator is exhausted.

A cycle of bar tacking A is performed to form bar tacking seams covering the start and end portions of the overedge chain stitches B, which has been beforehand formed by a sewing machine for holing as illustrated in FIG. 8, by moving the feed plate 3 laterally and longitudinally relative to the needle 42 in synchronism with the vertical movement of the needle 42 using a lockstitch bar tacking sewing machine equipped with such a buttonhole closing device. The bar tacking A prevents the sewn product 19 at the end of the buttonhole C in the extending direction (vertical direction in FIG. 8) thereof and the start and end portions of the overedge chain stitches B from being frayed.

The lateral and longitudinal relative movement of the feed plate 3 is made as follows. That is, a laterally feed arm 33 and a longitudinally feed arm 34 are connected to the carrier bar 32 incorporated with the feed plate 3, and a relative movement in the lateral and longitudinal directions is given to the feed plate 3 by way of the laterally feed arm 33 and longitudinally feed arm 34.

The operation of the above embodiment will be described hereinafter.

Figure 9:
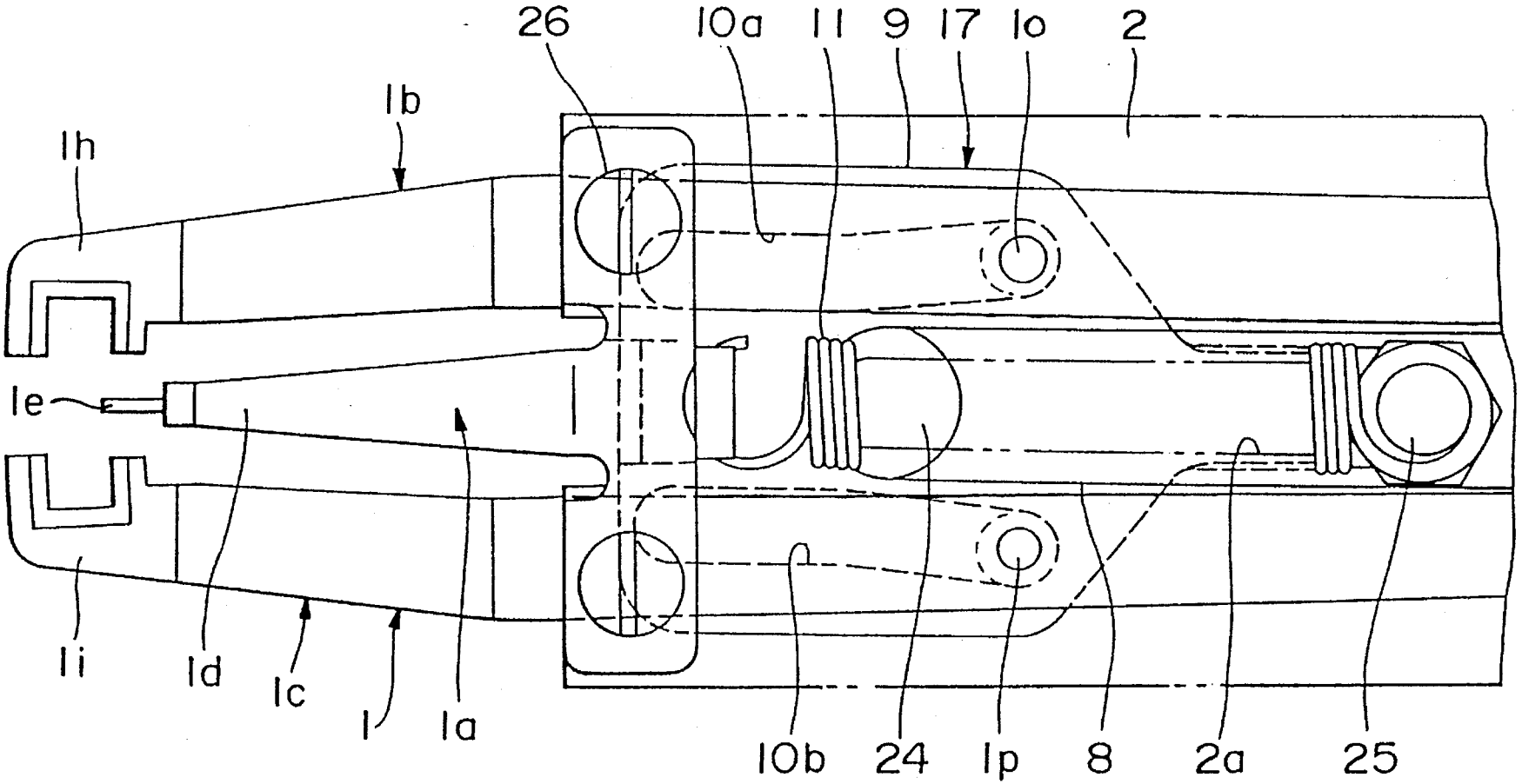
FIG. 9 is a view for explaining the operation of the buttonhole closing device in FIG. 1.

At first, the arch clamp frame 2 is swung upward at the tip end thereof about the pin 18 by way of the link 38 and the clamp foot unit 1 is also raised. At that time, the arch clamp frame 2 is swung upward against the resilience of the spring 28. The driving unit 7 of pneumatic actuator is exhausted and the upper and lower driving members 8 and 9 move forward together by the resilience of the driving unit 11 of return spring so that the pin portions 1*o* and 1*p* engaging the cam portions 10*a* and 10*b* of the lower driving member 9 are driven apart from each other and consequently the first and second movable clamp feet 1*b* and 1*c* are swung open about pins 14*a* and 14*b* respectively and the clamp portions 1*h* and 1*i* thereof are apart from each other as illustrated in FIG. 9.

At this state, the sewing operation of the lockstitch bar tacking sewing machine starts. At first, the buttonhole C around which the overedge chain stitches B has been beforehand formed in the sewn product 19 is put on the throat plate 13 in the opening portion 3*a* of the feed plate 3. Then a foot switch, not shown, is stepped as far as a first step to swing the link 38 so that the arch clamp frame 2 is swung down together with the clamp foot unit 1 by the resilience of the spring 28. The center clamp foot 1*a* of the clamp foot unit 1 which also lowers together therewith is inserted into the buttonhole C at the narrow positioning portion 1*e* thereof to thereby position the buttonhole C and consequently the portion of the sewn product 19 which is to be subjected to the bar tacking A with accuracy as illustrated in FIG. 7. At the same time, the sewn product 19 is elastically pressed upon the throat plate 13 at the portions thereof adjacent to the buttonhole C by way of the clamp portions 1*h* and 1*i* of the first and second movable clamp feet 1*b* and 1*c* respectively.

Then the foot switch is stepped down as far as a second step to start the operation of the lockstitch bar tacking sewing machine and operate the driving unit 7 of pneumatic actuator backward at the same time. As a result, the clamp foot unit driving mechanism 17 composed of the upper and lower driving members 8 and 9 gradually moves backward before the first stitch is formed, i.e., the needle 42 reaches the sewn product 19, and the pin portions 1*o* and 1*p* which respectively engage the cam portions 10*a* and 10*b* of the lower driving member 9 move in such a way as to narrow the distance therebetween so that the first and second movable clamp feet 1*b* and 1*c* are swung about the pins 14*a* and 14*b* respectively at the rear end portions thereof to gradually bring the clamp portions 1*h* and 1*i* thereof toward each other until they are in close contact with each other at the tip end portions 1*j* and 1*k* and at the rear end portions 1*m* and 1*n* thereof respectively, the rear end portions 1*m* and 1*n* clamping the positioning portion 1*e* of the center clamp foot 1*a* therebetween as illustrated in FIG. 10. As clamp portions 1*h* and 1*i* close, the portions of the sewn product 19 on the both sides of the buttonhole C adjacent thereto are brought inside by friction to close the buttonhole C.

Figure 11:
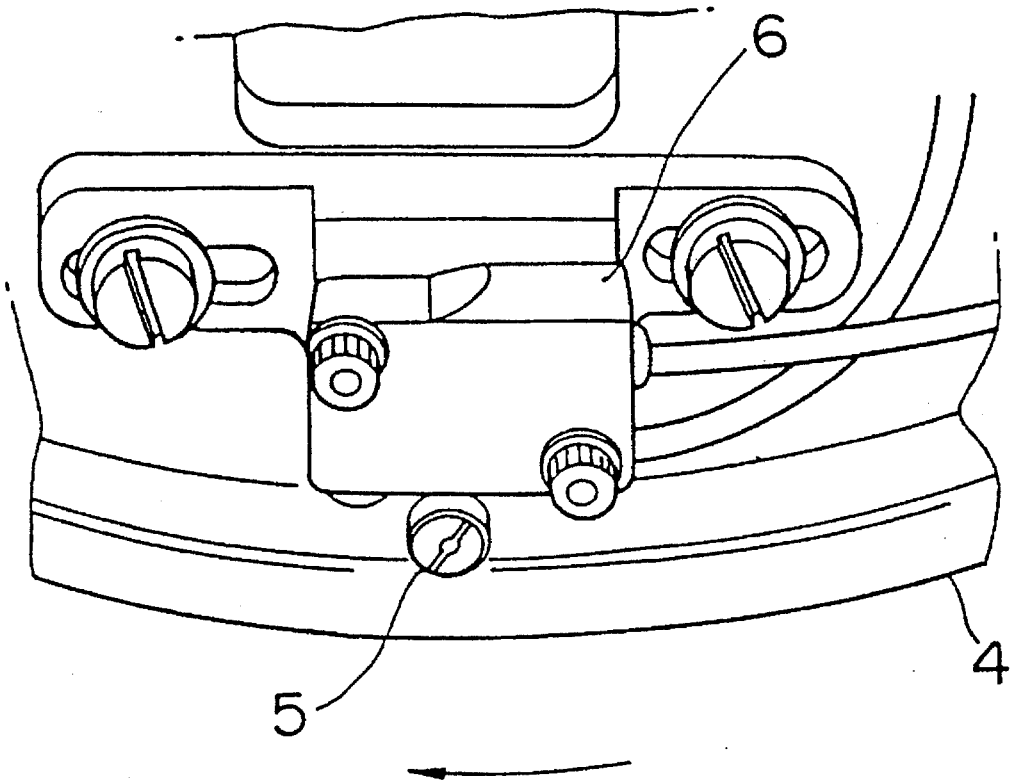
FIG. 11 is a perspective view showing a feed cam in FIG. 1.

The driving unit 7 of pneumatic actuator is operated backward as follows. That is, since a roller 5 is attached to a feed cam 4 which rotates in synchronism with the vertical movement of the needle 42 as illustrated in FIG. 11, the roller 5 rotates together with the feed cam 4 when the lockstitch bar tacking sewing machine starts operation to switch an air valve 6 mounted on a sewing machine body, not shown, to supply compressed air to the driving unit 7 of pneumatic actuator.

In the state wherein the buttonhole C is closed in this way and the overedge chain stitches B thereof are in close contact with each other, a cycle of sewing operation is performed to form a given number of stitches so as to apply the bar tacking A to the sewn product 19 over the start and end portions of the overedge chain stitches B. The feed plate 3 is moved relative to the needle 42 in the longitudinal (X-)

and lateral (Y-) directions in the bar tacking A as described above. This relative movement is performed on the basis of the variation of cam surface of the feed cam 4, but it is also possible to perform the relative movement by moving the feed plate 3 relative to the needle 42 in the same order based on an X-Y directional electric control without employing the feed cam 4.

As understood from the above description, the buttonhole closing device for a lockstitch bar tacking sewing machine can obtain the following effects.

Since the driving units for moving the first and second movable clamp feet toward the center line of the buttonhole can be arranged apart from the operator's hands, he can secure a broad space for handling the sewn product to improve operability. Moreover, since a driving unit to move each of the first and second movable clamp feet inside is exclusively provided for each of them, the first and second movable clamp feet can be moved at a proper time. As a result, it is possible to move the first and second movable clamp feet toward the center line of the buttonhole separately before the needle pierces the sewn product pressed to close the buttonhole and start sewing after the sewn product is supported by the lowered clamp foot unit, so that it is possible to close the buttonhole with certainty and perform a bar tacking to form decently aligned buttonhole stitches.

What is claimed is:

1. A buttonhole closing device for a lockstitch bar tacking sewing machine comprising:

a feed plate having an opening portion located at a needle hole of a throat plate for holding the buttonhole of the sewn product thereon;

an arch clamp frame the rear end portion of which is supported by the feed plate on the side thereof so as to be vertically swingable;

a center clamp foot which extends from the front end portion of the arch clamp frame for positioning the buttonhole of the sewn product;

first and second movable clamp feet which are separately connected to the arch clamp frame by way of a pin so as to be swingable left and right, the first and second clamp feet being located on both sides of the end portions of the overedge chain stitches of a sewn product;

a clamp foot unit driving mechanism;

pin portions and cam portions being located between the first and second movable clamp feet and the clamp foot unit driving mechanism for converting longitudinal movement of the clamp foot unit driving mechanism into lateral swinging of the first and second movable clamp feet;

a first drive unit located and supported on the arch clamp frame and connected to the clamp foot unit driving mechanism;

a second drive unit located and supported on the arch clamp frame and connected to the clamp foot unit driving mechanism; and the first and second driving units cooperating to move the clamp foot driving mechanism backward and forward causing the cam portions to effect opening or closing of the first and second movable clamp feet.

* * * * *